US005308194A

United States Patent [19]

Carruba

[11] Patent Number: 5,308,194

[45] Date of Patent: * May 3, 1994

[54] OFFSHORE SUPPORT STRUCTURE APPARATUS

[75] Inventor: Samuel C. Carruba, Fulshear, Tex.

[73] Assignee: CBS Engineering, Inc., Houston, Tex.

[ * ] Notice: The portion of the term of this patent subsequent to Jan. 26, 2010 has been disclaimed.

[21] Appl. No.: 960,592

[22] Filed: Oct. 13, 1992

Related U.S. Application Data

[63] Continuation-in-part of Ser. No. 608,382, Nov. 2, 1990, Pat. No. 5,181,799, which is a continuation-in-part of Ser. No. 503,704, Apr. 3, 1990, Pat. No. 5,026,210.

[51] Int. Cl.[5] ..... E02B 17/00

[52] U.S. Cl. ..... 405/195.1; 166/367; 405/227

[58] Field of Search ..... 405/195.1, 202, 203, 405/204, 224, 224.2, 227; 166/335, 367

[56] References Cited

U.S. PATENT DOCUMENTS

| | | | |
|---|---|---|---|
| 2,927,435 | 3/1960 | Upson | 405/227 |
| 3,306,052 | 2/1967 | Kawasaki | 405/205 |
| 3,516,259 | 6/1970 | Tokola | 405/208 |
| 3,852,969 | 12/1974 | Gibson et al. | 405/204 |
| 4,000,624 | 1/1977 | Chow | 405/204 |
| 4,558,973 | 12/1985 | Blandford | 405/216 |
| 4,818,145 | 4/1989 | Carruba | 405/203 |
| 4,842,446 | 6/1989 | Carruba | 405/227 |
| 5,181,799 | 1/1993 | Carruba | 405/195.1 |

*Primary Examiner*—David H. Corbin
*Attorney, Agent, or Firm*—Ben D. Tobor

[57] ABSTRACT

Apparatus for supporting a vertical member in an offshore environment, utilize support members which are secured to the vertical member by a doubler plate which is guided into an abutting relationship with the vertical member.

14 Claims, 11 Drawing Sheets

OFFSHORE SUPPORT STRUCTURE APPARATUS

1. RELATED APPLICATION

This application is a continuation-in-part of application Ser. No. 07/608,382, filed Nov. 2, 1990, now U.S. Pat. No. 5,181,799, which is a continuation-in-part of Ser. No. 503,704, filed Apr. 13, 1990, now U.S. Pat. No. 5,026,210, issued Jun. 25, 1991, both of which are commonly assigned herewith.

2. FIELD OF THE INVENTION

The invention relates to offshore support structure apparatus for use with wells located in a body of water, the wells having an upstanding conductor pipe extending from the ground below the body of water to above the surface of the water.

3. DESCRIPTION OF THE PRIOR ART

Typically in wells completed at offshore locations, the well has been drilled from a jackup drilling rig or a semi-submersible drilling rig, and the vessel which supports the drilling rig typically remains on location during the drilling process. When the drilling vessel is subsequently moved to another location, the well is typically left with suitable casing in the borehole extending to some selected depth and production tubing is also typically installed. A conductor pipe typically surrounds the casing and extends into the ground below the body of water and it typically extends upwardly beyond the surface of the water a distance of between 15 and 45 feet, or perhaps higher. The conductor pipe may have a diameter from 30 to 100 inches. The water depth may be from 40–50 feet to 200–250 feet deep, which are considered relatively shallow offshore depths.

The well is typically shut in by installing suitable closed valves or plugs in the well, and the conductor pipe is thus left unsupported, extending from the ground beneath the body of water to above the surface of the water. In order to produce hydrocarbons from the well, it is necessary that some type of platform structure, such as a production platform, be installed above the well in order that the hydrocarbons from the well can be produced. As is conventional in the art, well production equipment is typically installed upon the production platform at the well. In some instances, the production platform is fabricated as an integral unit on shore and then towed to the location of the well and installed. Such integral production platforms are not fabricated quickly and they must be designed and fabricated to exactly conform to the particular water depth and soil conditions and elevations present at the site of the offshore well. Accordingly, the exposed and unsupported conductor pipe can be unprotected and unsupported for a period of time which can be from twelve to eighteen months until after the completion of the well, at which time the totally fabricated production platform is ready for installation at the offshore well. During that period of time the free-standing conductor pipe is vulnerable to damage from navigating ships in the area, and it can also be damaged by forces exerted by the body of water caused by severe weather conditions such as winter storms and/or summer hurricanes. It is thus susceptible to bending and damage when left unprotected. Accordingly, it would be desirable to economically and efficiently support the conductor pipe to protect it until such time as a production platform structure can be permanently installed.

In view of the high cost of the typical permanent production platform, which is typically fabricated as an integral unit and installed at the offshore well, it would be desirable if a support structure for supporting the conductor pipe could also be utilized to either assist in supporting a platform structure, or to provide enough support to the conductor pipe, so that the conductor pipe could support a platform structure disposed upon the conductor pipe. Such double duty by the support structure would greatly reduce the costs associated with the production platform. By reducing the costs of placing the well into production, it is thus possible that some less productive, or marginal, offshore wells could be placed into production of hydrocarbons.

Such a support structure for the conductor pipes of offshore wells has been previously proposed and utilized as disclosed in U.S. Pat. No. 4,558,973. However, it is believed that such a support structure has presented some problems. This prior art support structure utilizes a clamp structure to secure the support structure to the conductor pipe and the clamp structure extends from the ground below the body of water upwardly over and along a substantial portion of the length of the conductor pipe disposed under the surface of the water. This clamp structure utilizes a plurality of bolts extending along its length, which bolts must be tightened by divers at the time of installation of the support structure. Further, at least four piles must be driven to secure the support structure to the ground below the body of water. Thus, an extensive amount of time and energy is required in installing such a support structure, particularly with respect to the great number of bolts which must be secured. Such bolts require the services of an underwater diver to complete the bolt fastening step, as well as the time and effort necessary to drive the four piles.

Accordingly, prior to the development of the present invention, there have been no offshore support structure apparatus for use with conductor pipes of offshore wells which: are simple and economical to manufacture and use; are easily assembled; require a minimum amount of work to be performed by underwater divers; and require a minimum number of piles to be driven into the ground beneath the body of water.

Therefore, the art has sought offshore support structure apparatus for use with conductor pipes of offshore wells which: are simple and economical to manufacture and use; are easily assembled; require a minimum amount of work by underwater divers; and require a minimum number of piles to be driven into the ground beneath the body of water.

SUMMARY OF THE INVENTION

In accordance with the invention, the foregoing advantages have been achieved through the present support structure for use with an offshore well located in a body of water, the well having an upstanding conductor pipe, having upper and lower ends, extending from the ground below the body of water to above the surface of the water. The present invention includes: two tubular legs, each leg having upper and lower ends and adapted to extend from the ground to at least the surface of the water; a pile skirt disposed on each of the two legs, at the lower end of each of the two legs; and means for connecting the upper ends of each of the two legs to the conductor pipe, the two legs being radially spaced from one another, the connection means including a doubler plate fixedly secured to the upper end of each of the tubular legs, and means for guiding each doubler plate into an abutting and sliding relationship with the conductor pipe, the guiding means being adapted to be fixedly secured to the upper end of the conductor pipe at least at the surface of the water or higher, whereby the two legs and connection means can be secured at their upper ends to the conductor pipe and the lower ends of the legs can be moved downwardly into contact with the ground. A further feature of the present invention is that a platform structure may be disposed upon the conductor pipe.

Another feature of the present invention is that a pile skirt may be fixedly secured, or pivotably secured, to the lower end of each leg. A further feature of the present invention is that the guiding means may include a pair of upstanding, elongate guide plates, having upper and lower ends, adapted to be disposed in a spaced and substantially parallel relationship with the conductor pipe, the pair of guide plates being spaced apart from each other to receive the doubler plate and guide the doubler plate into an abutting and sliding relationship with the conductor pipe. Another feature of the present invention is that the upper ends of the guide plates may taper downwardly toward the conductor pipe.

The offshore support structure apparatus for use with a well having an upstanding conductor pipe of the present invention, when compared with previously proposed prior art offshore support structure or apparatus, has the advantages of: being simple and economical to manufacture and use; is easily assembled; requires a minimum amount of time and effort being spent by underwater divers; and requires a minimum number of piles to be driven into the ground beneath the body of water.

While the invention will be described in connection with the preferred embodiment, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF THE INVENTION

Figure 1:
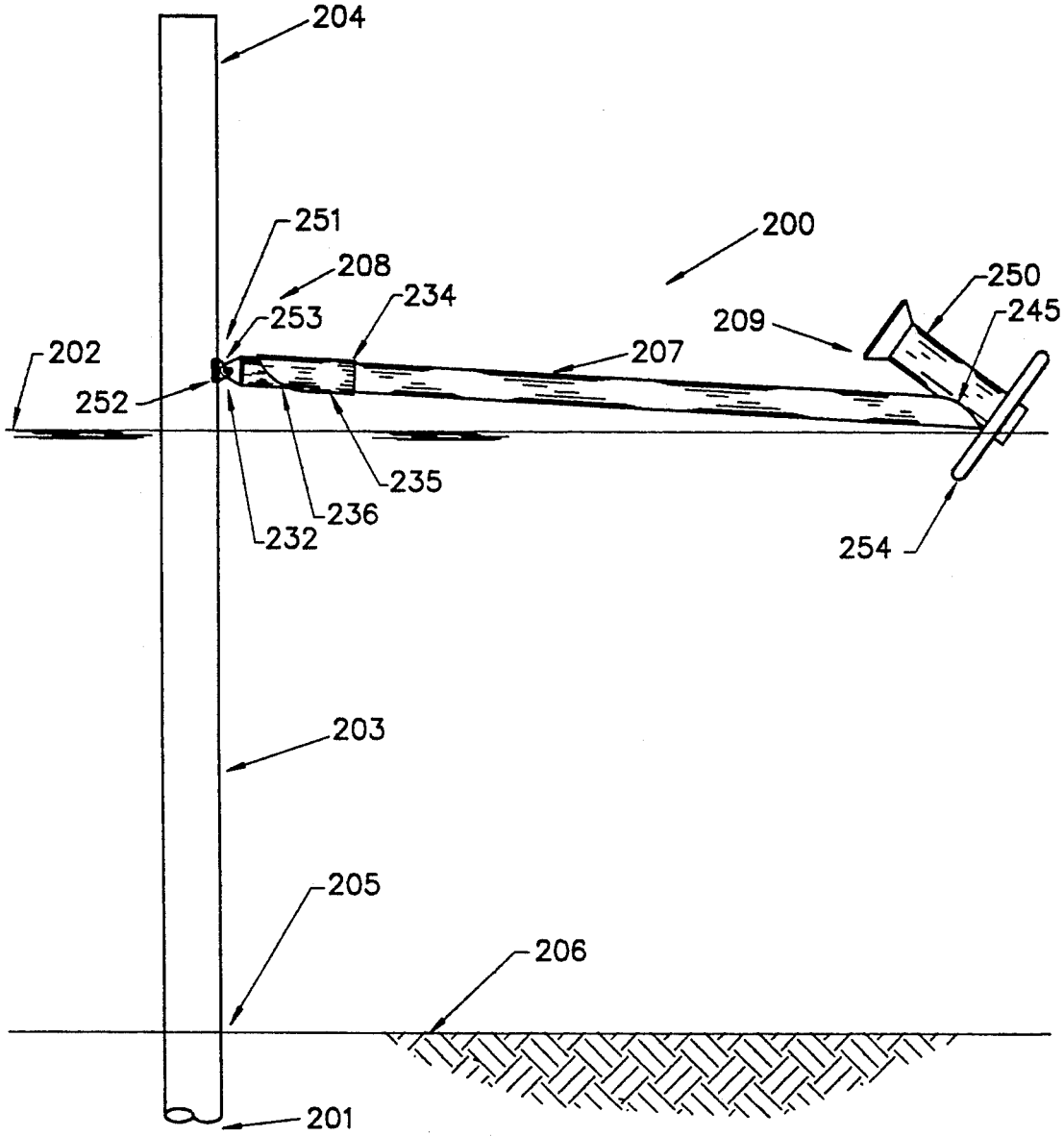
FIG. 1 is a side view of a support structure.
Figure 2:
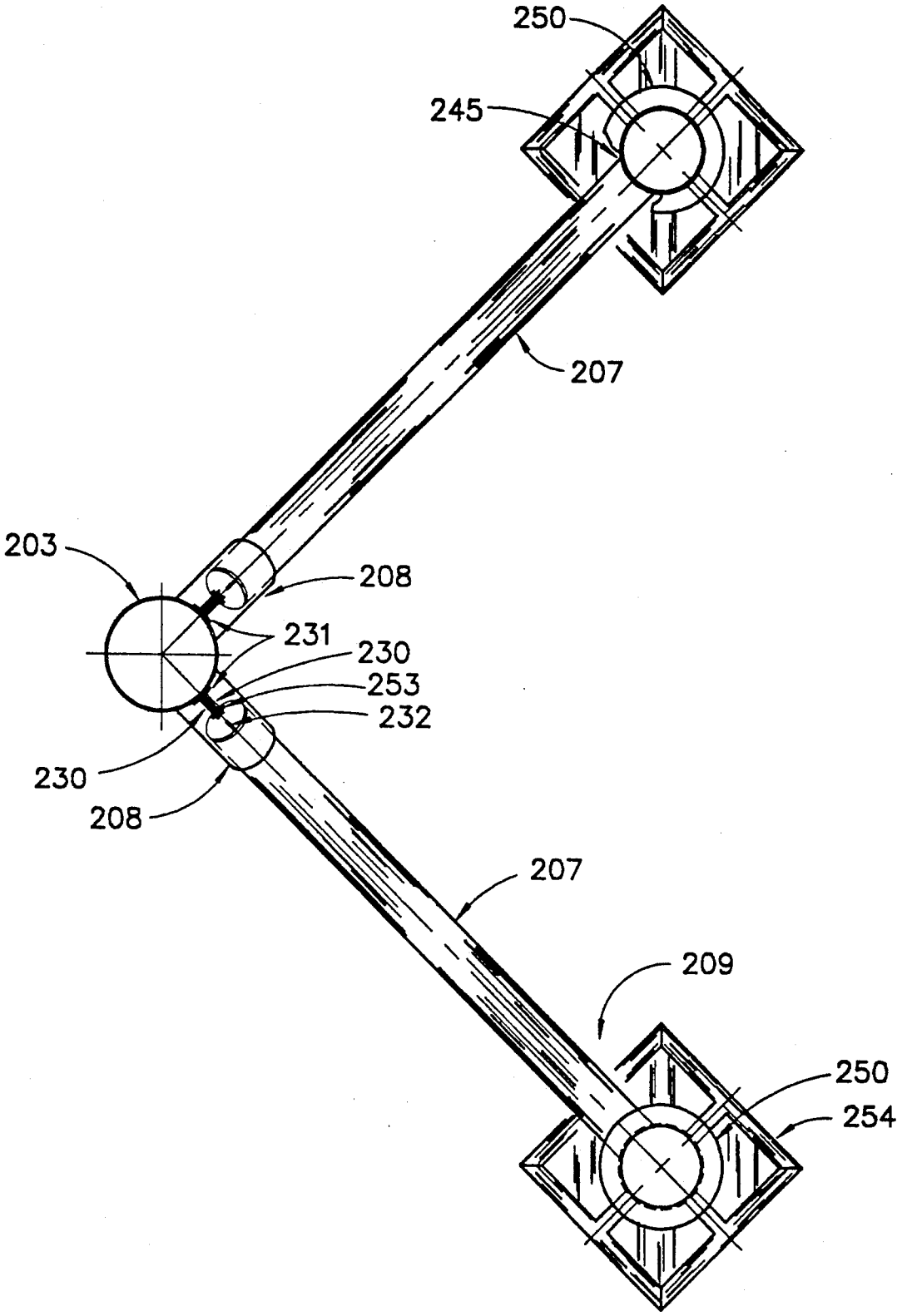
FIG. 2 is a top view of the support structure of FIG. 1.
Figure 3:
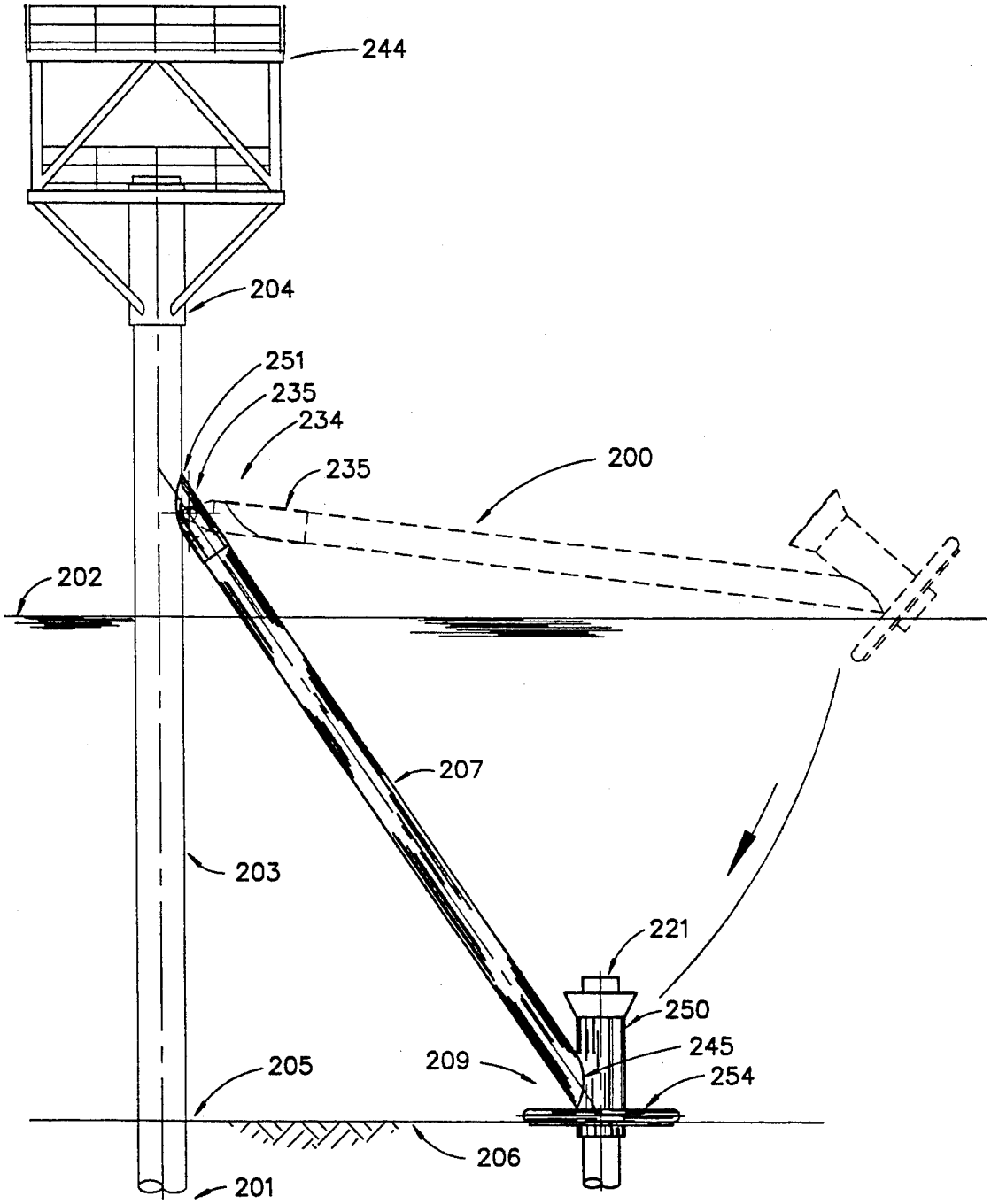
FIG. 3 is a side view of the support structure of FIG. 1, illustrating a platform structure being supported by the conductor pipe.

With reference to FIGS. 1–3, a support structure 200 is shown in use with a well 201 located in a body of water 202, the well 201 having an upstanding conductor pipe 203, having upper and lower ends 204, 205, extending from the ground below the body of water 202 to above the surface of the water 202. Support structure 200 generally includes two tubular legs 207, each leg 207 having upper and lower ends 208, 209; a pile skirt 250 fixedly secured to each of the two legs 207, at the lower end 209 of each of the two legs 207; and means for pivotably connecting 251 the upper ends 208 of each of the two legs 207 to the conductor pipe 203.

As will be hereinafter described in greater detail, upon legs 207 being pivoted downwardly, as shown in dotted lines in FIG. 3, into engagement with ground 206, each tubular leg 207 extends from the ground 206 to at least the surface of the water 202 and preferably above the surface of the water 202, as seen in FIGS. 1 and 3. As seen in FIG. 2, each of the two legs 207 are radially spaced from one another. The pivotal connection means 251 is preferably disposed upon the conductor pipe 203 at a location at least at the surface of the water 202 and preferably above the surface of the water 202, as shown in FIGS. 1 and 3.

Preferably, pivotal connection means 251 preferably includes a hook member 252, adapted to be fixedly secured to the conductor pipe 203 as by welding, for each leg 207, which hook members 252 are radially spaced about the conductor pipe 203 as by welding, as seen in FIG. 2. Each hook member 252 is associated with the upper end 208 of a leg 207, whereby legs 207 are freely pivotable with respect to conductor pipe 203, about hook members 252 and pivot pins 253 associated with the upper ends 208 of legs 207. Preferably, the hook members 252 are each formed of two hook-shaped plate members 230 attached to, or formed integral with, a base plate member 231, base plate member 231 being secured to conductor pipe 203, as by welding, as seen in FIG. 2. The upper end 208 of each leg 207 preferably has a plate member 232 extending therefrom which has a pivot pin 253 fixedly secured thereto, as by welding, and passing therethrough, as seen in FIG. 2. Alternatively, as will be readily seen by one of ordinary skill in the art, other pivotal connections, such as a hook and eye connection or other pivot pin joints, could be utilized for pivotal connection means 251.

A means for securing 234 each leg 207 to conductor pipe 203 may be associated with the upper end 208 of each log 207. Preferably each securing means 234 comprises a slidable sleeve 235 disposed upon the upper end 208 of each leg 207. The upper end 236 of each sleeve 235 preferably has a rounded and tapered configuration, whereby after leg 207 has been pivoted downwardly, as shown in FIG. 3, sleeve 235 may be moved upwardly to abut conductor pipe 203 in a close fitting, abutting relationship with the conductor pipe 203. Preferably, sleeve 235 is then fixedly secured to conductor pipe 203, as by welding, and sleeve 235 may also be secured, as by welding, to the upper end 208 of leg 207. Securing means 234 then serves to relieve stresses and strains exerted upon pivotal connection means 251, as well as, protect pivotal connection means 251 from the elements in order to reduce corrosion thereof. Alternatively, after leg 207 is pivoted downwardly into the position shown in FIG. 3, pivotal connection means 251, or hook members 252 and pivot pins 253 can be fixedly secured to one another as by welding to maintain the relative position of legs 207 with respect to conductor pipe 203, as shown in FIGS. 2 and 3.

Preferably, each pile skirt 250 has a conventional mud mat 254 fixedly secured thereto. Mud mats 254 are provided to pile skirts 250 to prevent them from sinking into potentially soft ground 206 before piles 221 (FIG. 3) can be driven through pile skirts 250. Each pile skirt 250 is fixedly secured to the lower end 209 of legs 207 as by welding as shown at 245.

Still with reference to FIGS. 1-3, the method for supporting an upstanding conductor pipe 203 of a well 201 located in a body of water 202 will be described. The method generally comprises the steps of: transporting, as by floating in the water, two legs 207; disposing the upper ends 208 of each leg 207 adjacent the portion of the conductor pipe 203 extending above the surface of the water 202; pivotably connecting the upper ends 208 of each of the two legs 207 to the conductor pipe 203 at the surface of the water 222, or at a location upon the conductor pipe 203 higher than the surface of the water 202; pivoting each of the legs 207 downwardly until the pile skirt 250 of each leg 207 contacts the ground 206; and driving a single pile 221 through each pile skirt 250 to fixedly secure each leg 207 to the ground 206, whereby the conductor pipe 203 is supported toward its upper end 204 within the body of water 202. The method further preferably includes the step of circumferentially disposing a mud mat 254 about each pile skirt 250. The method may further preferably include the steps of pivotably connecting the upper ends 208 of each leg 207 to the conductor pipe 203 by disposing two hook members 252 radially spaced about the conductor pipe 203, each hook member 252 engaging a pivot pin 253 associated with the upper end 208 of each log 207. With reference to FIG. 3, it is seen that the method may further include the step of disposing a platform structure 244 upon the conductor pipe 203, the platform structure 244 being fixedly secured to only the conductor pipe 203.

The method may further include the step of securing the upper end 208 of each leg 207 to the conductor pipe 203, which step may be accomplished by sliding upwardly a sleeve 235 disposed upon the upper end 208 of each leg 207 into an abutting and mating relationship with conductor pipe 203 and welding sleeve 235 to the conductor pipe 203 and the leg 207.

Figure 4:
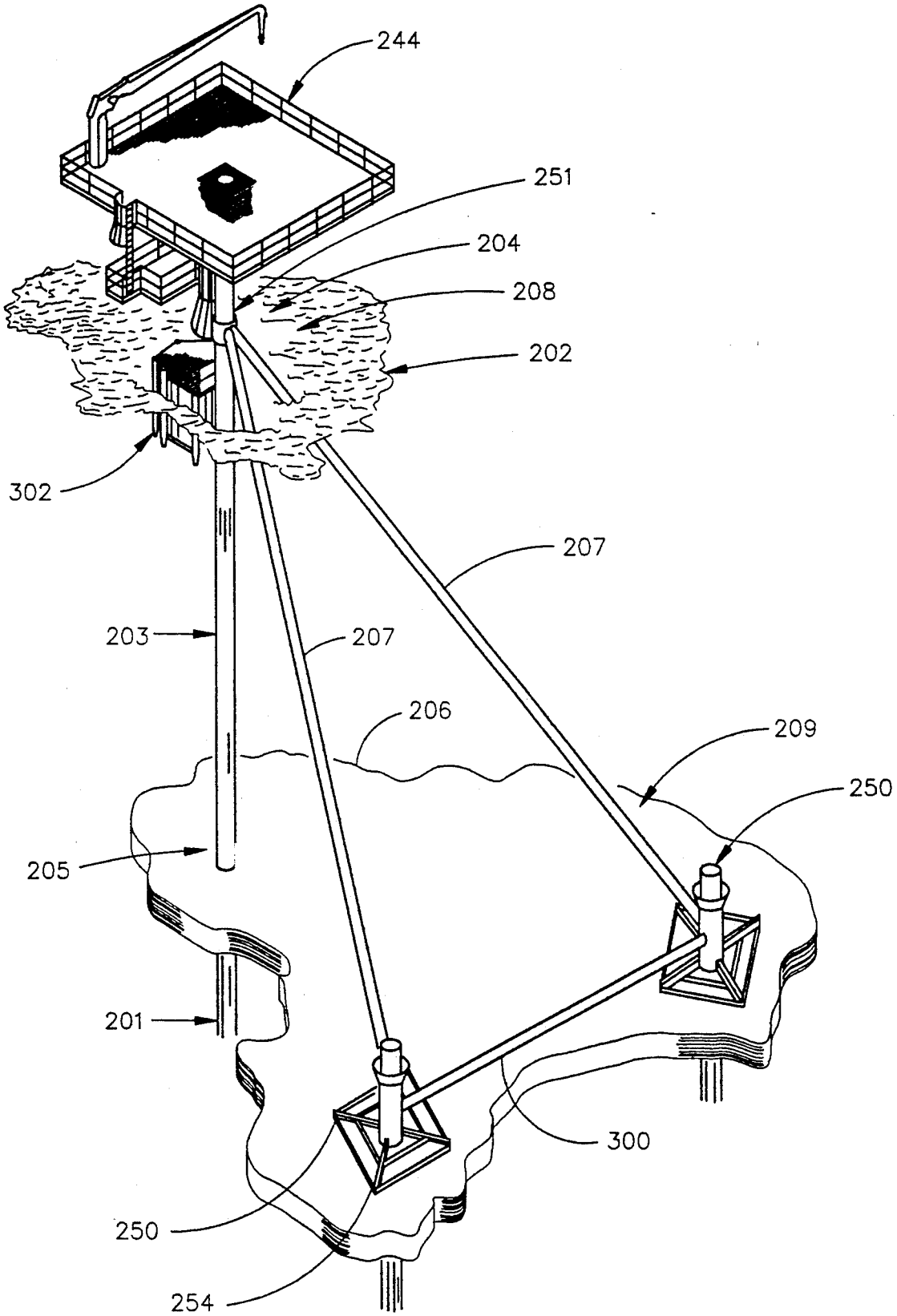
FIG. 4 is a perspective view of another embodiment of a support structure.

With reference to FIG. 4, another embodiment of a support structure 200′ is shown in use with a well 201 located in a body of water 202, the well 201 having an upstanding conductor pipe 203, having upper and lower ends 204, 205 extending from the ground 206 below the body of water 202 to above the surface of the water 202. For ease of description, the same reference numerals as used in FIGS. 1-3 are used in FIG. 4 for elements which are the same in construction and operation as those previously described. Elements having similar construction will have primed reference numerals. Support structure 200′ generally includes two tubular legs 207, each leg 207 having upper and lower ends 208, 209; a pile skirt 250 fixedly secured to each leg 207 at the lower end 209 of each of the two legs 207; at least one pile skirt bracing member 300 extending between and connecting the two pile skirts 250; and means for connecting 251′ the upper ends 208 of each of the two legs 207 to the conductor pipe 203.

Figure 7:
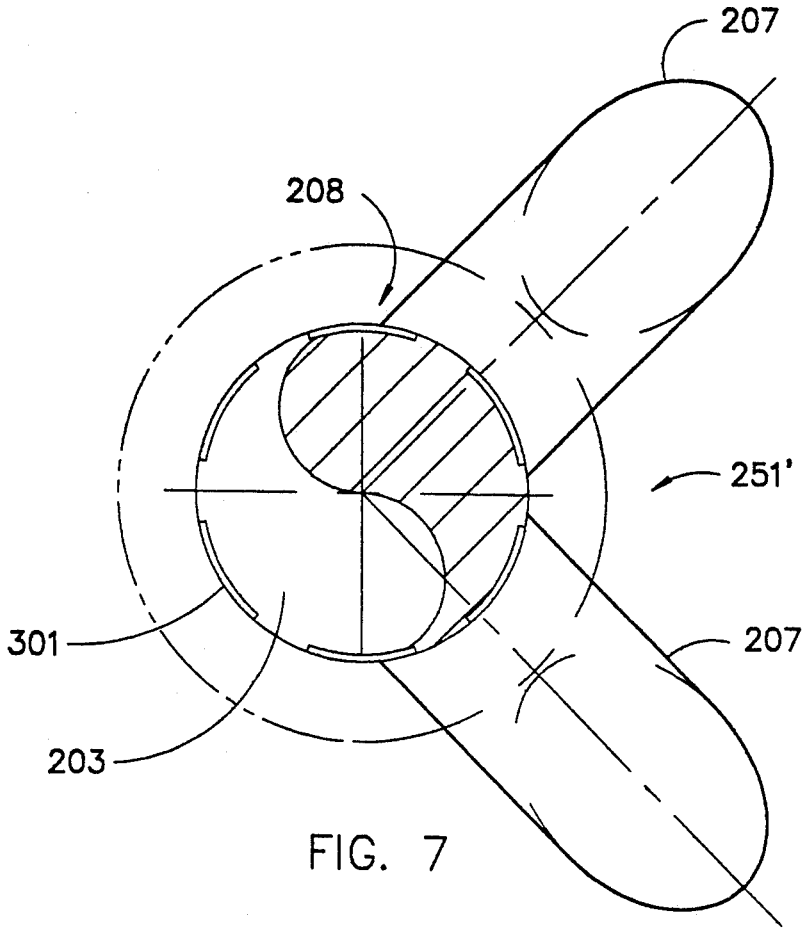
FIG. 7 is a top view of the leg connection means of FIG. 6.
Figure 6:
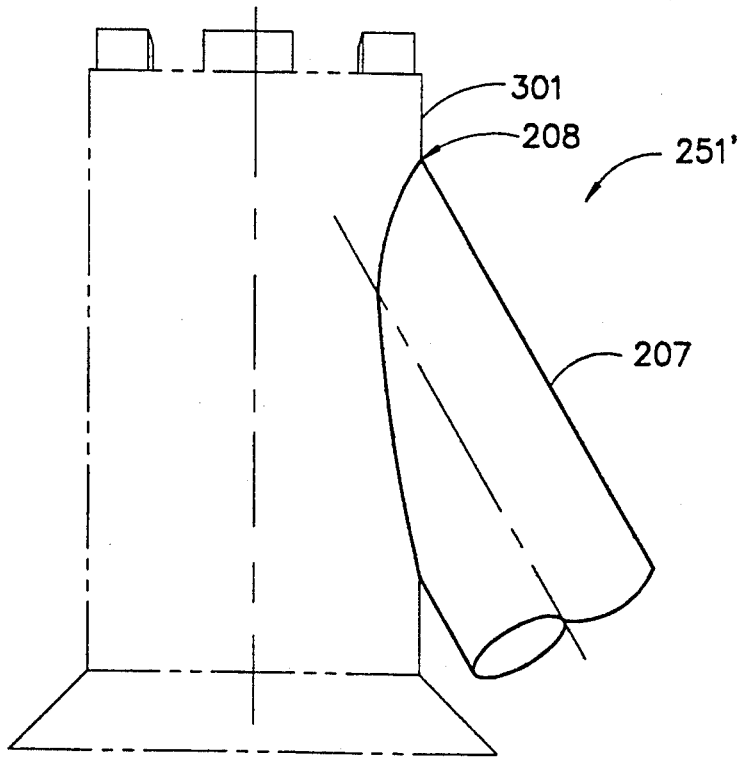
FIG. 6 is a front view of a leg connection means.

In the embodiment of support structure 200′ illustrated in FIG. 4, connection means 251′ may comprise a tubular sleeve 301 (FIGS. 6 and 7) having the two upper ends 208 of the two tubular legs 207 associated therewith, as by welding the upper ends 208 of legs 207 to tubular sleeve 301. When installing support structure 200′, the tubular sleeve 301 is preferably passed over the upper end 204 of conductor pipe 203, and support structure 200′ is lowered until the mud mats 254 and pile skirts 250 are disposed upon ground 206 below the body of water 202. If desired, sleeve 301 may then be fixedly secured to conductor pipe 203 as by welding or grouting.

Alternatively, connection means 251′ may be a doubler plate 302 (FIG. 4) having the two upper ends 208 of the two tubular legs 207 associated therewith, as by welding. When installing support structure 200′ having doubler plate 302, support structure 200′ is lowered until the skirt piles and mud mats 250, 254 contact the ground 206, and doubler plate 302 is abutted against, and welded to, the upper end 204 of conductor pipe 203.

Figure 9:
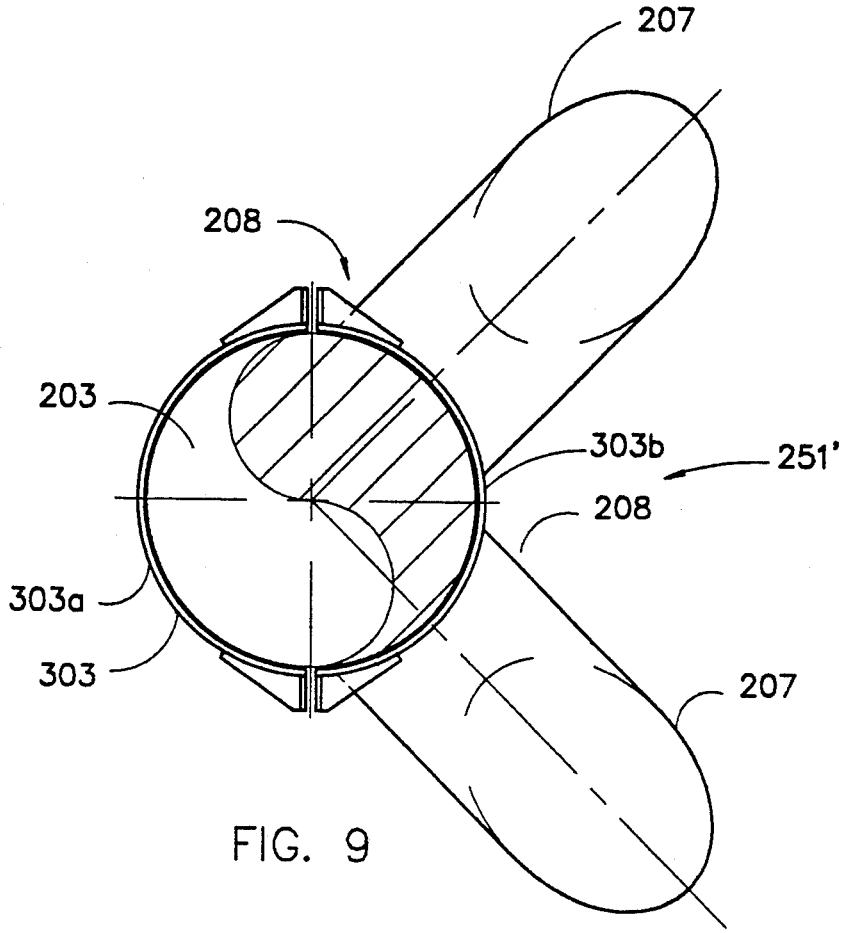
FIG. 9 is a top view of the leg connection embodiment of FIG. 8.
Figure 8:
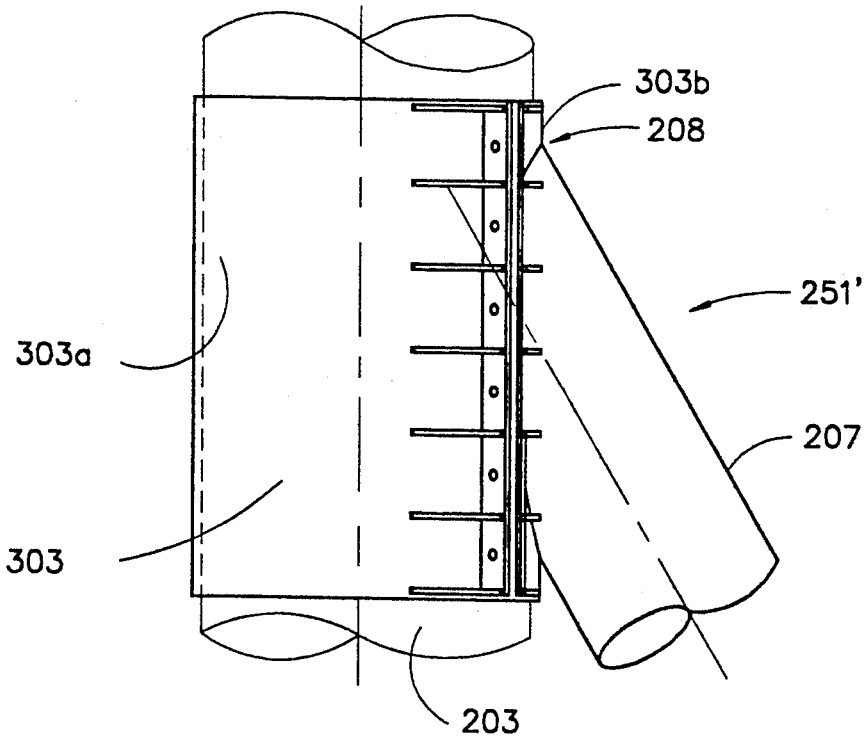
FIG. 8 is a front view of another embodiment of a leg connection means.

Still with reference to FIG. 4, connection means 251′ may also comprise a clamp 303 (FIGS. 8 and 9) having the two upper ends 208 of the two tubular legs 207 associated therewith, as by welding, or in some other suitable fashion fixedly securing the upper ends 208 of legs 207 to clamp 303. Clamp 303 is preferably a two-part type clamp 303*a*, 303*b*, one section 303*b* of which preferably has the upper ends 208 of legs 207 fixedly secured thereto. When installing support structure 200′ having clamp 303 being utilized as connection means 251′, clamp 303 is passed over the upper end 204 of conductor pipe 203, and structure 200′ is lowered until pile skirts 250 and mud mats 254 contact the ground 206. Clamp 303 is then tightened, in a conventional manner, to secure the clamp to the upper end 204 of conductor pipe 203. Alternatively, pipe clamp 303 may be welded to conductor pipe 203 in a conventional manner. Alternatively, a portion of clamp 303 could be removed, and support structure 200′ could be installed in the same manner as it is installed when connection means 251 is a doubler plate 302. After a portion 303*b* of clamp 303 has been abutted against the upper end 204 of conductor pipe 303, the other portion 303*a* of clamp 303 could be connected and clamp 303 is either tightened, or welded, to secure clamp 303 to the upper end 204 of conductor pipe 203.

Figure 11:
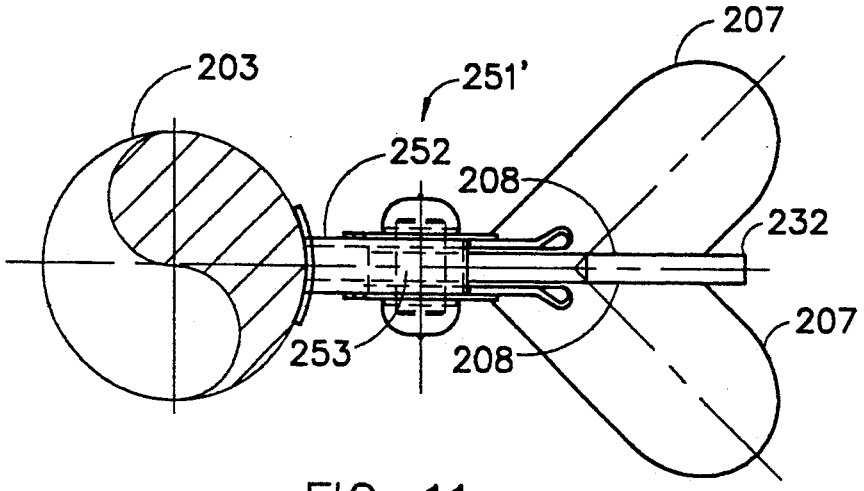
FIG. 11 is a top view of the leg connection means of FIG. 10.
Figure 10:
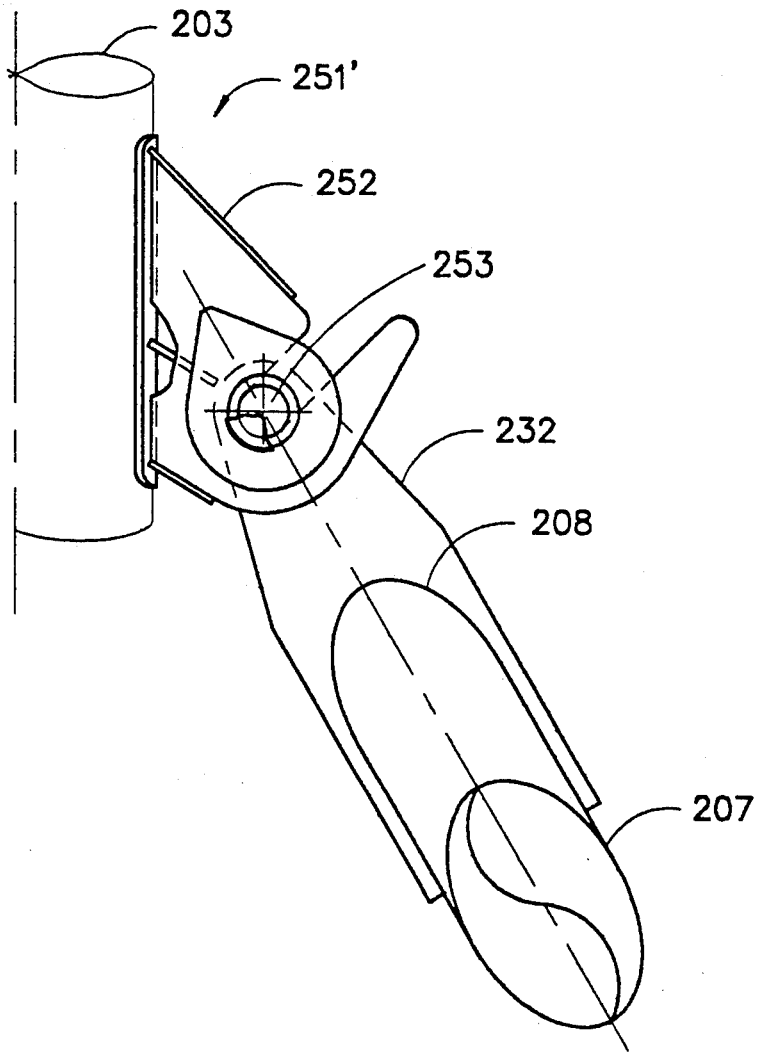
FIG. 10 is a front view of another leg connection means.

Still with reference to FIG. 4, connection means 251′, could be a pivotal connection 251 as that previously described in connection with FIGS. 1-3, or as shown in FIGS. 10 and 11, and the installation of support structure 200′ will be the same as that previously described in connection with support structure 200 of FIGS. 1-3, with the exception that both legs 207, along with skirt piles 250, would be lowered and pivoted as a unit due to the utilization of the at least one pile skirt bracing member 300.

Figure 5:
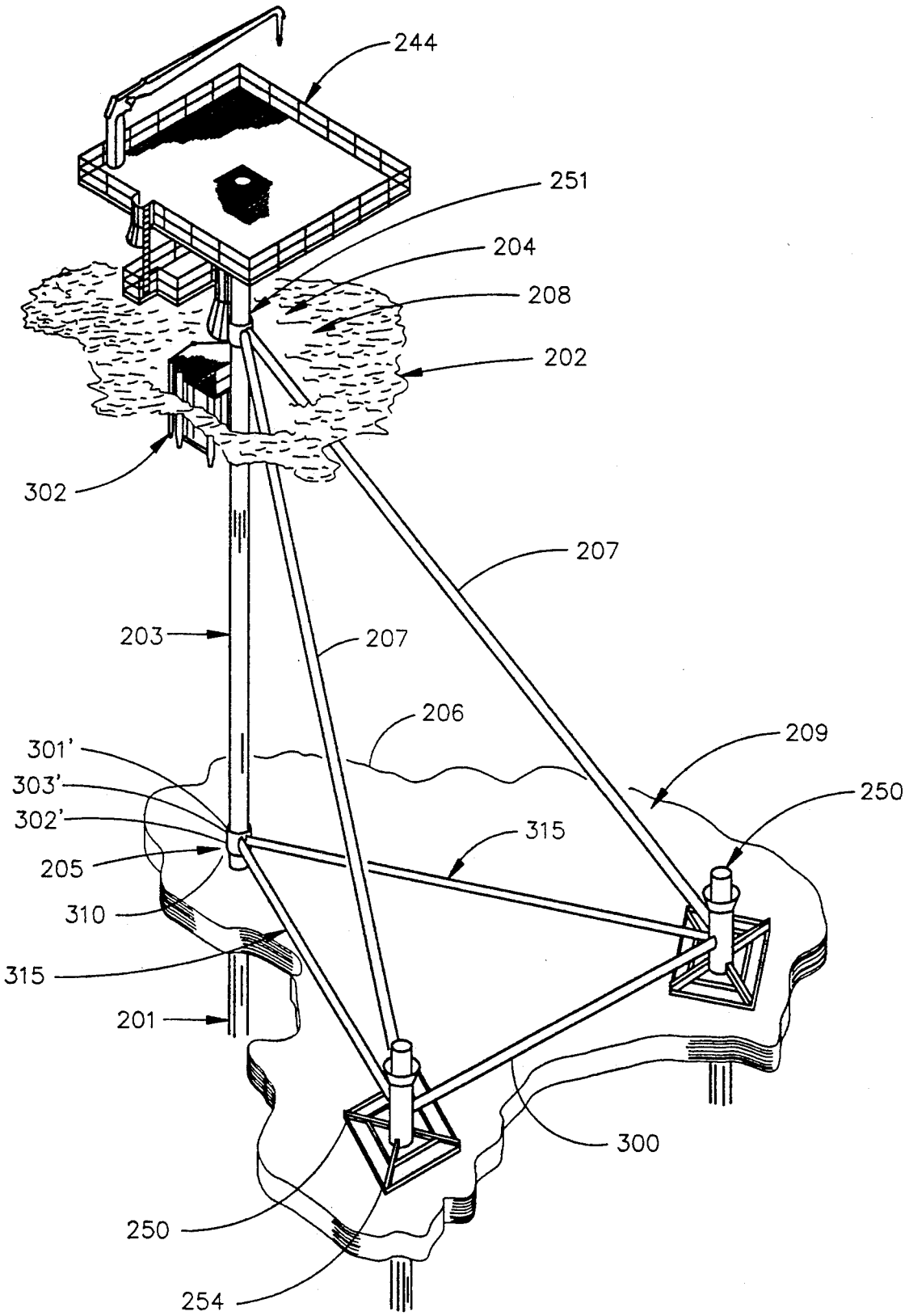
FIG. 5 is a perspective view of another embodiment of a support structure.

With reference to FIG. 5, another embodiment 200″ of a support structure is shown. The same reference numerals will be used for the same elements as those previously described in connection with FIGS. 1-4, and primed reference numerals will be used for elements which are similar to those previously described in connection with FIGS. 1-4. Support structure 200" is substantially similar to support structure 200', but differs in the inclusion of a means for connecting 310 the pile skirts 250 to the conductor pipe 203, with at least one bracing member 315 extending between, and connecting, the pile skirts 250 to the pile skirt connection means 310. As previously described in connection with FIG. 4, connection means 251' may be a sleeve 301 (FIGS. 6 and 7), doubler plate 302 (FIG. 4), clamp 303 (FIGS. 8 and 9), or pivotal connection 251 (FIGS. 10 AND 11). Pile skirt connection means 310 could be either a sleeve 301' (FIGS. 6 and 7), doubler plate 302' (FIG. 4), or clamp 303' (FIGS. 5, 8 and 9) all as previously described in regard to connection means 251'; in each case, the bracing members 315 being associated with pile skirt connection means 310, as by fixedly securing bracing members 315 to sleeve 301', doubler plate 302' or clamp 303'.

Still with reference to FIG. 5, the installation of support structure 200" would be dependent upon the choice for connection means 251' and pile skirt connection means 310. For example, if a sleeve 301' or clamp 303, were utilized as pile skirt connection means 310, it would be necessary to lower support structure 200" downwardly with the upper end 204 of conductor pipe 203 passing through sleeve 301' or clamp 303' until pile skirts and mud mats 254 contact the ground 206. With pile skirt connection means 310 being either sleeve 301' or clamp 303', connection means 251' could be a sleeve 301, doubler plate 302, or clamp 303, in which case sleeve 301 or clamp 303, would have the upper end 204 of conductor pipe 203 pass therethrough. If a doubler plate 302 is utilized, it would be abutted against the upper end 204 conductor pipe 203, in the manner previously described in connection with FIG. 4. In all instances, it would be preferred to fixedly secure connection means 251' to the upper end 204 of conductor pipe 203 in the manner previously described in connection with FIGS. 1-4.

Still with reference to FIG. 5, if doubler plate 302' is utilized as pile skirt connection means 310, connection means 251' could be either sleeve 301, doubler plate 302, clamp 303, or pivotal connection 251, all of which would be utilized in a manner as previously described in connection with FIGS. 1-4.

With reference to FIGS. 12-15, another embodiment of support structure 200, in accordance with the present invention, is shown in use with a well 201 located in a body of water 202, the well 201 having an upstanding conductor pipe 203, having upper and lower ends 204, 205 extending from the ground 206 below the body of water 202 to above the surface of the water 202. For ease of description, the same reference numerals as used in FIGS. 1-11 are used in FIGS. 12-15 for elements which are the same in construction and operation as those previously described. Elements having similar construction will have primed reference numerals. Support structure 200 generally includes two tubular legs 207, each leg 207 having upper and lower ends 208, 209; a pile skirt 250 disposed on each of the two legs 207 at the lower end 209 of each of the two legs 207; and means for connecting 251', the upper ends 208 of each of the two legs 207 to the conductor pipe 203.

Figure 12:
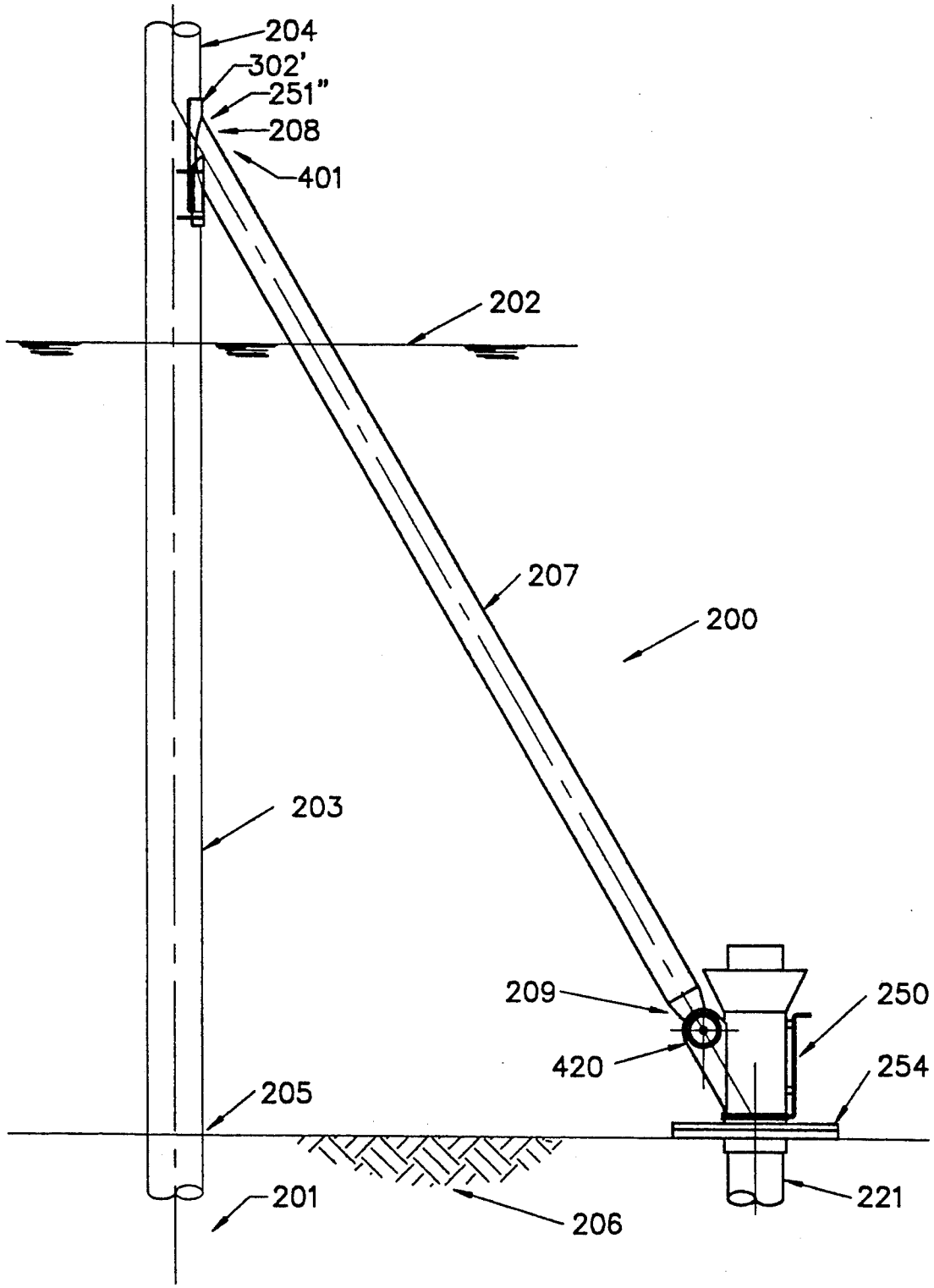
FIG. 12 is a front view of a support structure in accordance with the present invention.
Figure 14:
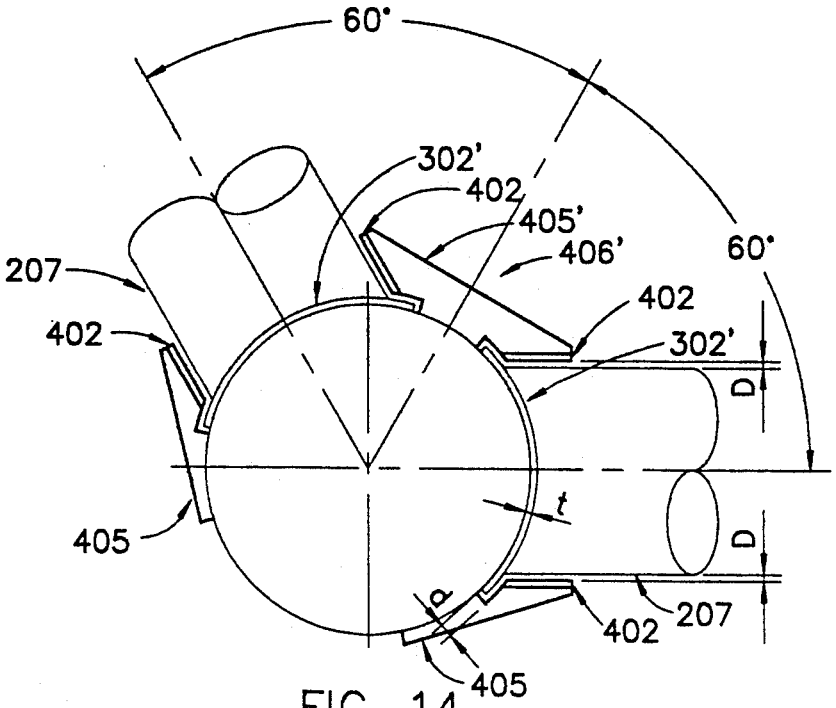
FIG. 14 is a top view of the structure of FIG. 13, in accordance with the present invention.
Figure 13:
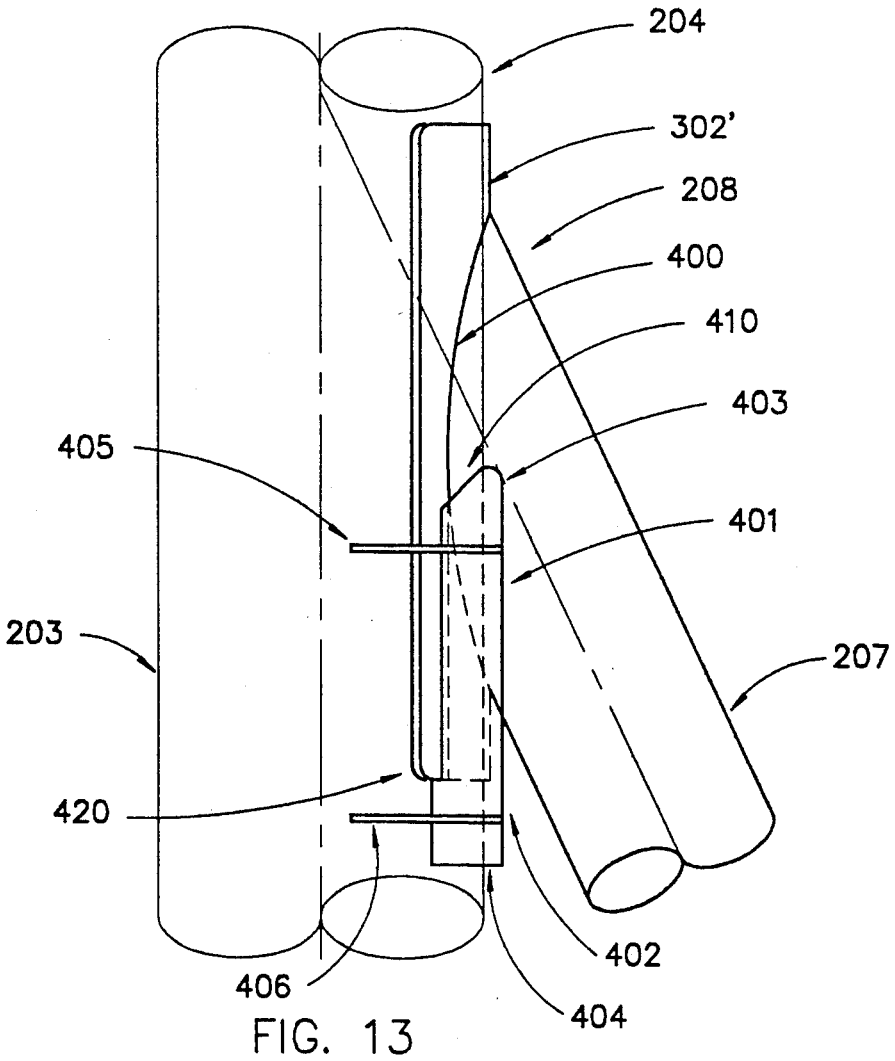
FIG. 13 is an enlarged front view of a portion of the connection means of the support structure of FIG. 12, in accordance with the present invention.

In the embodiment of support structure 200 illustrated in FIGS. 12-15, connection means 251", as illustrated in FIGS. 13-14, may comprise a doubler plate 302' fixedly secured, as by welding along line 400 to the upper end 208 of each of the 30 tubular legs 207; and means for guiding 401 each doubler plate 302' into an abutting and sliding relationship with conductor pipe 203. Preferably, guiding means 401 is adapted to be fixedly secured to the upper end 204 of conductor pipe 203, as by welding, as will be hereinafter described in greater detail. Preferably, guiding means 401 includes a pair of upstanding, elongate guide plates 402 having upper and lower ends 403, 404 which are disposed in a spaced and substantially parallel relationship with the conductor pipe 203, as shown in FIG. 14. Guide plates 402 are spaced from conductor pipe 203 a distance d (FIG. 14), which distance d substantially corresponds to the thickness t of doubler plate 302'. Preferably, the pair of guide plates 402 for each tubular leg 207 are spaced apart a distance D (FIG. 14) to permit tubular leg 207 with its associated doubler plate 302' to pass downwardly between the pair of guide plates 402, whereby doubler plate 302' is received within the pair of guide plates 402. The pair of guide plates 402 guide the doubler plate 302' and its associated tubular leg 207 into an abutting and sliding relationship with the conductor pipe 203, as shown in FIGS. 13 and 14.

The pairs of guide plates 402 are preferably disposed in their spaced and substantially parallel relationship with the conductor pipe 203 in any suitable manner, such as by a pair of upper and lower support plates 405, 406, which are welded to conductor pipe 203 at its upper end 204 above body of water 202, and to the upper and lower ends 403, 404 of guide plates 402. As illustrated in FIG. 14, tubular legs 207 are angularly disposed, or radially spaced, about the circumference of conductor pipe 203, the two tubular legs 207 being disposed approximately 120 degrees radially apart from each other; however, it should be apparent to one of ordinary skill in the art, that the angular disposition between tubular legs 207 can be greater or less than 120 degrees. Preferably, tubular legs 207 are disposed less than 180 degrees, but greater than 10 degrees, apart from one another. As seen in FIG. 14, if desired, a single support plate 405' may be utilized to support two guide plates 402, with a similarly constructed lower support plate 406' (not shown) also being used to support the lower ends 404 of the two guide plates 402. The upper ends 403 of each guide plate 402 may also be preferably provided with a tapered surface 410, which tapered surface 410 tapers downwardly toward the conductor pipe 203 as illustrated in FIG. 13. This tapered surface 410 assists guide plates 410 in guiding doubler plate 302 into the sliding and abutting relationship with conductor pipe 203 as illustrated in FIG. 13.

Figure 15:
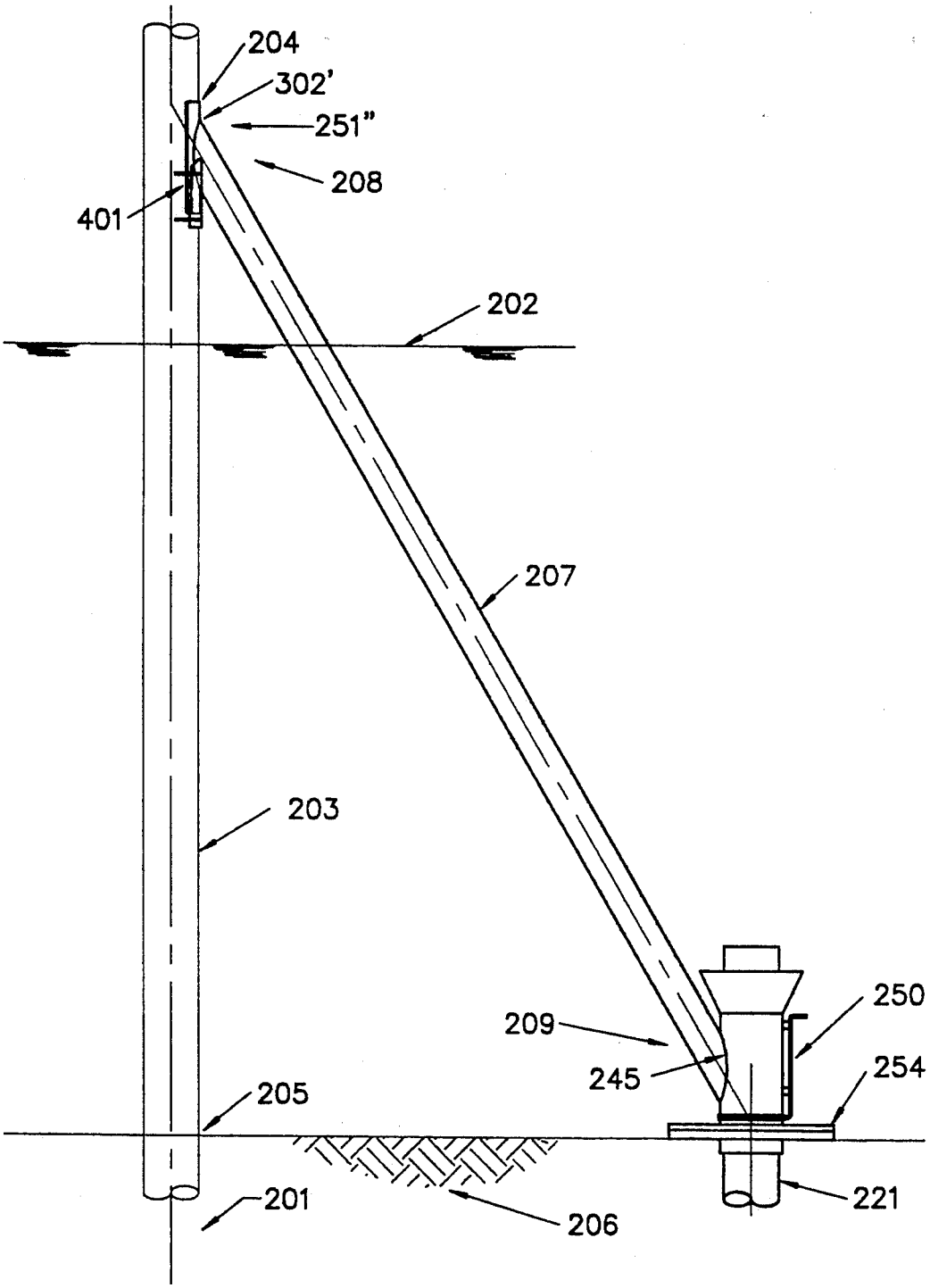
FIG. 15 is a front view of a support structure in accordance with the present invention.

As illustrated in FIGS. 12 and 15, the lower end 209 of each tubular leg 207 is provided with a pile skirt 250 which has a conventional mudmat 254 fixedly secured thereto. Mudmats 254 are provided to pile skirts 250 to prevent them from sinking into potentially soft ground 206 before piles 221 can be driven through pile skirt 250. The pile skirts 250 may be fixedly secured to the lower end 209 of tubular legs 207 as by welding as shown at 245 in FIG. 15, or may be pivotably secured to the lower end 209 of each tubular leg 207 as by a pivotable connection 420, as shown in FIG. 12.

Still with reference to FIGS. 12-15, the method for supporting an upstanding conductor pipe 203 of a well 201 located in a body of water 202 will be described. The method generally comprises the steps of: transporting the two legs 207, as by floating in the water, or having them placed on a barge; disposing the upper ends 208 of each leg 207 adjacent the portion of the conductor pipe 203 extending above the surface of the water 202; lowering each tubular leg 207 downwardly toward guide means 401 with doubler plate 302, being received by guide means 401 and doubler plate 302, being disposed in a sliding and abutting relationship with conductor pipe 203; and continuing lowering tubular legs 207 until mudmat 254 pile skirt 250 is disposed upon the ground 206 beneath body of water 202. Preferably, doubler plate 302, is guided into the desired sliding and abutting relationship with conductor pipe 203, as by lowering leg 207 until the bottom surface 420 of doubler plate 302' contacts tapered surfaces 410 of the mating pair of guide plates 402, and moving doubler plate 302' downwardly along tapered surface 410 until it enters the space d between the guide plates 402 and conductor pipe 203, and further lowering leg 207, whereby doubler plate 302' slides downwardly along conductor pipe 203 in a sliding and abutting relationship. If desired, after mudmat 254 of pile skirt 250 is disposed in the configuration illustrated in FIGS. 12 or 15, doubler plates 302' may be welded to conductor pipe 203 to provide further support and strength to support structure 200. Thus, conductor pipe 203 is supported toward its upper end 204 within the body of water 202. Alternatively, tubular legs 207 may be lowered downwardly into the body of water 202 until mudmats 254 of pile skirts 250 engage the ground 206 beneath body of water 202, and the upper end 208 of each tubular leg 207 may be pivoted, or tilted, toward conductor pipe 203. The upper ends 208 of tubular legs 207 are then moved downwardly, in the manner previously described, to permit guide means 401 to guide doubler plates 302' into the desired sliding and abutting relationship with conductor pipe 203.

It is to be understood that the invention is not limited to the exact details of construction, operation, exact materials or embodiments shown and described, as obvious modifications and equivalents will be apparent to one skilled in the art; for example, the guide means may be removed from the conductor pipe after the doubler plates have been fixedly secured, as by welding, to conductor pipe 203. Accordingly, the invention is therefore to be limited only by the scope of the appended claims.

I claim:

1. A support structure for use with a well located in a body of water, the well having an upstanding conductor pipe having upper and lower ends, extending from the ground below the body of water to above the surface of the water, comprising:

two tubular legs, each leg having upper and lower ends and adapted to extend from the ground to at least the surface of the water;

a pile skirt disposed on each of the two legs, at the lower end of each of the two legs; and means for connecting the upper ends of each of the two legs to the conductor pipe, the two legs being radially spaced from one another, the connection means including a doubler plate fixedly secured to the upper end of each of the tubular legs, and means for guiding each doubler plate into an abutting and sliding relationship with the conductor pipe, the guiding means being adapted to be fixedly secured to the upper end of the conductor pipe at least at the surface of the water or higher, whereby the two legs and connection means can be secured at their upper ends to the conductor pipe and the lower ends of the legs can be moved downwardly into contact with the ground.

2. The support structure of claim 1, wherein each pile skirt has a mud mat fixedly secured thereto.

3. The support structure of claim 1, wherein a platform structure is disposed upon the conductor pipe.

4. The support structure of claim 1, wherein a pile skirt is fixedly secured to the lower end of each leg.

5. The support structure of claim 1, wherein a pile skirt is pivotably secured to the lower end of each leg.

6. The support structure of claim 1, wherein the guiding means includes a pair of upstanding, elongate guide plates having upper and lower ends, and are adapted to be disposed in a spaced and substantially parallel relationship with the conductor pipe, the pair of guide plates being spaced apart from each other to receive the doubler plate and guide the doubler plate into an abutting and sliding relationship with the conductor pipe.

7. The support structure of claim 6, wherein the upper ends of the guide plates taper downwardly toward the conductor pipe.

8. A support structure for use with a well located in a body of water, an upstanding conductor pipe having upper and lower ends, adapted to extend from the ground below the body of water to above the surface of the water, comprising:

two tubular legs, each leg having upper and lower ends and adapted to extend from the ground to at least the surface of the water;

a pile skirt disposed on each of the two legs, at the lower end of each of the two legs; and means for connecting the upper ends of each of the two legs to the conductor pipe, the two legs being radially spaced from one another, the connection means including a doubler plate fixedly secured to the upper end of each of the tubular legs, and means for guiding each doubler plate into an abutting and sliding relationship with the conductor pipe, the guiding means being fixedly secured to the upper end of the conductor pipe at least at the surface of the water or higher, whereby the two legs and connection means can be secured at their upper ends to the conductor pipe and the lower ends of the legs can be moved downwardly into contact with the ground.

9. The support structure of claim 8, wherein each pile skirt has a mud mat fixedly secured thereto.

10. The support structure of claim 8, wherein a platform structure is disposed upon the conductor pipe.

11. The support structure of claim 8, wherein a pile skirt is fixedly secured to the lower end of each leg.

12. The support structure of claim 8, wherein a pile skirt is pivotably secured to the lower end of each leg.

13. The support structure of claim 8, wherein the guiding means includes a pair of upstanding, elongate guide plates having upper and lower ends, disposed in a spaced and substantially parallel relationship on the conductor pipe, the pair of guide plates being spaced apart from each other to receive the doubler plate and guide the doubler plate into an abutting and sliding relationship with the conductor pipe.

14. The support structure of claim 13, wherein the upper ends of the guide plates taper downwardly toward the conductor pipe.

* * * * *